United States Patent [19]

Muskulus

[11] Patent Number: 4,544,315

[45] Date of Patent: Oct. 1, 1985

[54] SEPARATION OF SHEET METAL ELEMENTS FROM A STACK

[75] Inventor: Willi Muskulus, Frankfurt, Fed. Rep. of Germany

[73] Assignee: Statomat-Globe Maschinenfabrik GmbH, Niederdorfelden, Fed. Rep. of Germany

[21] Appl. No.: 443,898

[22] Filed: Nov. 23, 1982

[30] Foreign Application Priority Data

Nov. 26, 1981 [DE] Fed. Rep. of Germany ..... 3146848
Nov. 27, 1981 [DE] Fed. Rep. of Germany ..... 3147034

[51] Int. Cl.[4] ..... B65G 59/06

[52] U.S. Cl. ..... 414/115; 221/227; 414/131; 414/786

[58] Field of Search ..... 414/115, 786, 125, 129, 414/131; 221/227, 251, 268

[56] References Cited

U.S. PATENT DOCUMENTS 3,892,319 7/1975 Sarring ..... 414/115
4,013,179 3/1977 Fluck ..... 221/268 X
4,439,100 3/1984 Fichtner et al. ..... 414/115

FOREIGN PATENT DOCUMENTS 535510 10/1931 Fed. Rep. of Germany ..... 221/268
211232 9/1960 Fed. Rep. of Germany ..... 414/131
2656705 5/1978 Fed. Rep. of Germany .
587043 1/1978 U.S.S.R. ..... 221/268

*Primary Examiner*—Robert J. Spar
*Assistant Examiner*—Janice Krizek
*Attorney, Agent, or Firm*—Larson and Taylor

[57] ABSTRACT

A method of separating at least one sheet metal element from the lower end of a stack (4) of apertured sheet metal elements, the separation comprising utilizing in motion phases two tool parts (1, 2), the method comprising:

(a) a first motion phase, wherein sheet metal elements become sufficiently shifted by translation and/or rotation relative to one another at a separation plane of the stack that those elements do not inter-engage at their apertures; and (b) a second motion phase, wherein below the plane, the shifted sheet metal element(s) is(are) lowered from the plane, this lowering being such that in a third motion phase, those lowered element(s) will become completely separated from the rest of the stack by being further shifted sideways; wherein in the method:

(i) sheet metal elements to be separated are gravitationally lowerable; and (ii) sheet metal element(s) remaining in the stack during the second motion phase is(are) held by support provided at the bottom surface of the remaining stack.

10 Claims, 6 Drawing Figures

Fig. 1
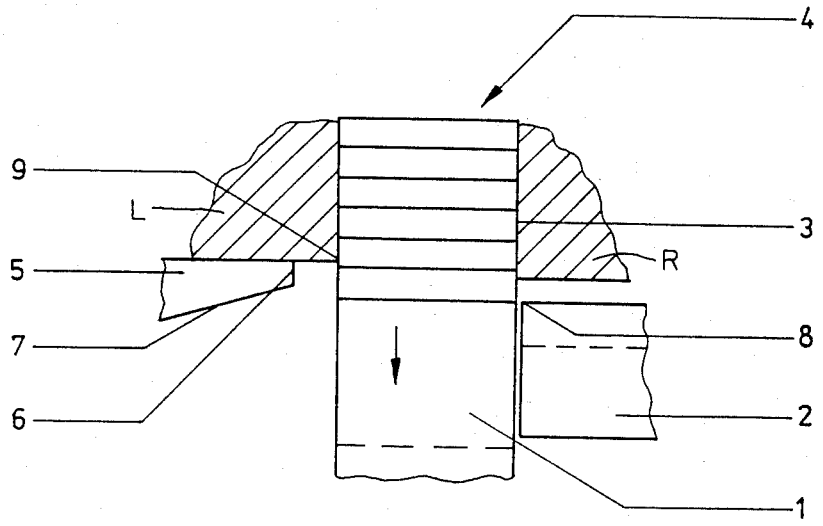
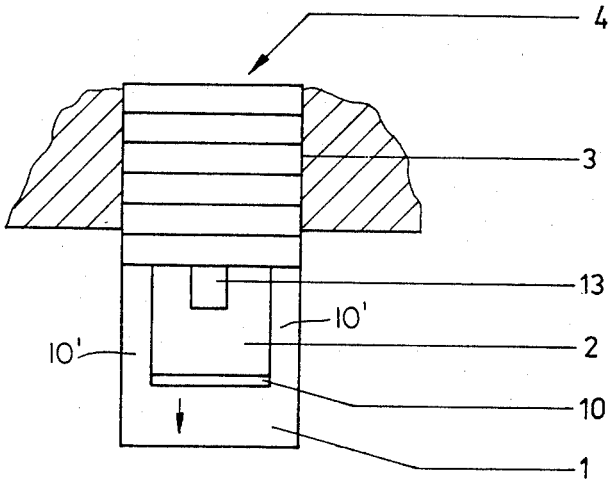
Fig. 2

Fig. 3
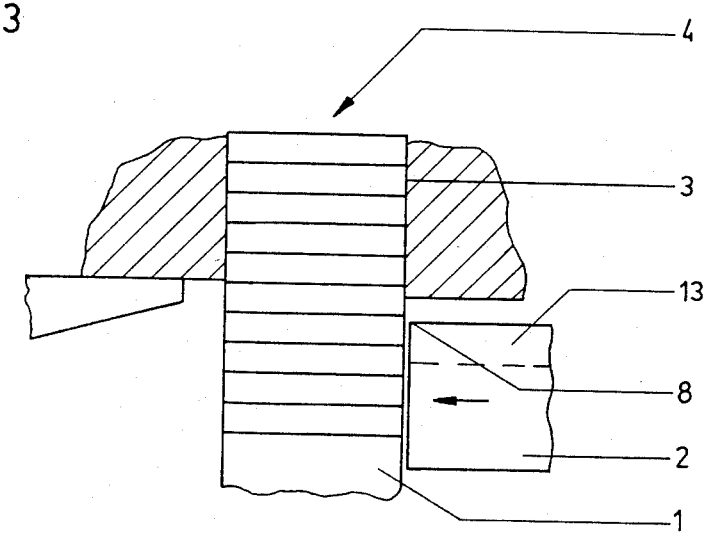
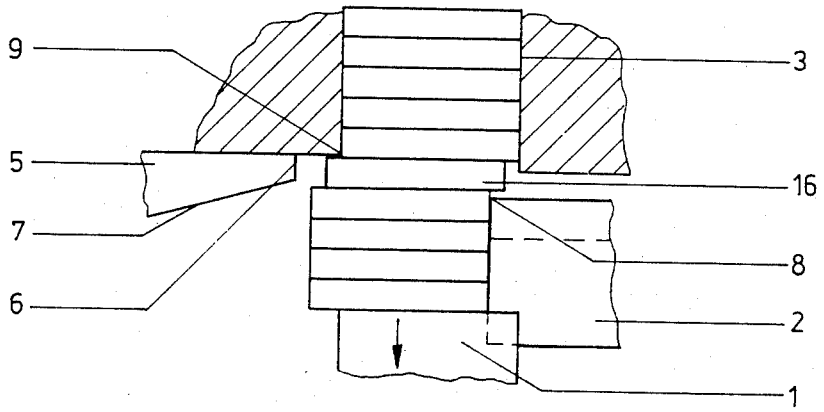
Fig. 4

Fig. 5
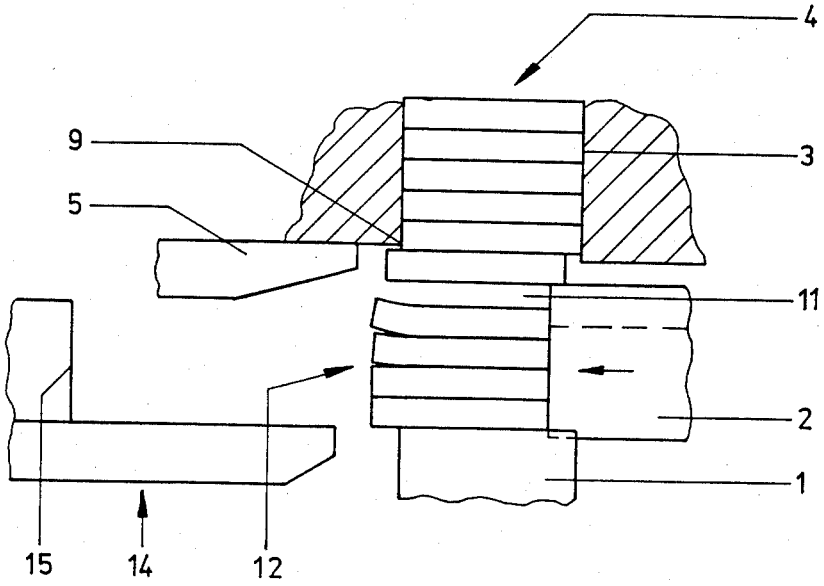
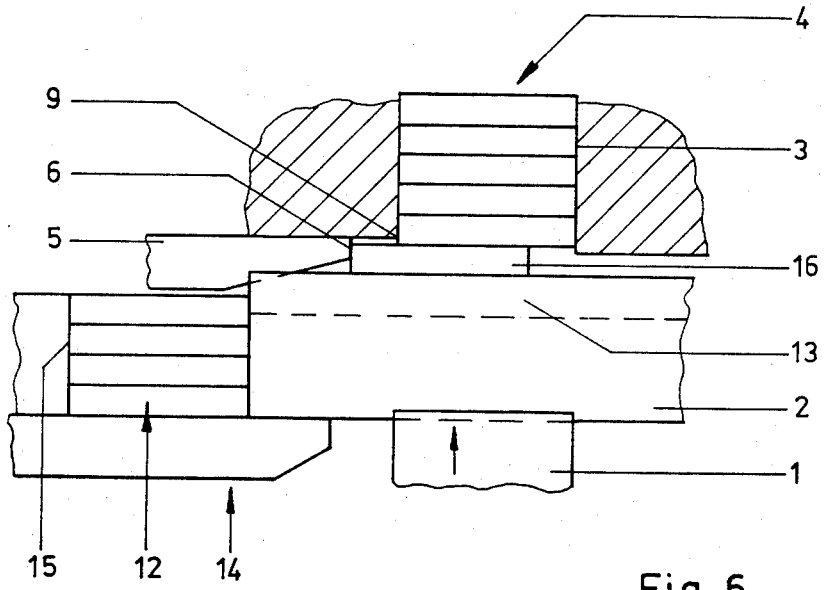
Fig. 6

SEPARATION OF SHEET METAL ELEMENTS FROM A STACK

FIELD OF THE INVENTION

One or more sheet metal elements having punched apertures can be separated from the lower end of a guided stack of apertured sheet metal elements, the separation comprising motion phases utilising two tool parts, wherein:

(a) in a first motion phase at a plane of separation of the stack, sheet metal elements are displaced such that those elements do not inter-engage at their apertures, the displacement comprising motion of translation and/or of rotation;

(b) in a second motion phase, the at least one displaced element below the separation plane is lowered to provide a separation gap from the plane to the at least one lowered element; and (c) in a third motion phase, the separated at least one element is shifted sideways to complete separation thereof, this shift being without inter-engagement of apertures of a plurality of the shifted elements when such a plurality is present.

BACKGROUND OF THE INVENTION

A method and apparatus for separation are disclosed in German laid-open patent application specification No. 29 49 230 (having corresponding GB patent application specification No. 2065613A and U.S. Pat. No. 4,439,100.). That apparatus can comprise:

(a) mandrels rotatable relative to one another and introduceable into apertures in the sheet metal elements, the mandrels partly having undercut surfaces for drawing sheet metal elements axially away from one another; or (b) transverse slides displaceable parallel to one another, one of which having a sloping under surface for lifting sheet metal element(s) remaining in the stack after the last motion phase, so that thereafter another transverse slide can run thereunder before the sheet metal elements to be separated are pushed wholly out of a notional continuation of a guide duct supporting said stack.

In one embodiment, the apparatus is relatively complicated, and can be used only with sheet metal elements having specific apertures. In another embodiment, it is necessary to lift (with application of very considerable force that might deform sheet metal elements) the possibly very high stack at the same time as pressure is being applied by a wedging effect against a side wall of a guide duct containing the stack. Both of those embodiments have disadvantages that should be obviated, if possible.

German laid-open patent application specification No. 26 56 705 discloses apparatus having a slide able to push sideways the lowest sheet metal element of a stack of apertured sheet metal elements, the pushing producing sideways and flat shift of that element. If the slide encounters resistance, the slide can yield downwardly in its wedge-shaped guide. The sheet metal elements slide flat one on another at a separation plane during the entire shift motion. Thus, it is possible for sheet metal elements to become caught at their apertures.

SUMMARY OF THE INVENTION

A first aspect of the present invention provides a method of separating at least one sheet metal element from the lower end of a stack of apertured sheet metal elements, the separation comprising utilising in motion phases two tool parts, the method comprising:

(a) a first motion phase, wherein sheet metal elements become sufficiently shifted by translation and/or rotation relative to one another at a separation plane of the stack that those elements do not inter-engage at their apertures; and (b) a second motion phase, wherein below the plane, the shifted sheet metal element(s) is (are) lowered from the plane, this lowering being such that in a third motion phase, those lowered element(s) will become completely separated from the rest of the stack by being further shifted sideways; wherein in the method:

(i) sheet metal elements to be separated are gravitationally lowerable; and (ii) sheet metal elements(s) remaining in the stack during the second motion phase is (are) held by support provided at the bottom surface of the remaining stack.

A second aspect of the present invention provides apparatus suitable for separating at least one sheet metal element from a stack of apertured sheet metal elements, comprising:

(a) guide duct means for guideably issuing the stack, the duct having a lower end from which can gravitationally issue the at least one element;

(b) plunger means lowerable so that the top thereof returnably descends from a first level to a second level, and returnably descends from the second level to a third level, (i) the first level enabling the plunger top to support thereon the stack;

(ii) the second level providing lowering of the at least one issued element and lowering of the rest of the stack, such that a plane of separation will exist between the top of the at least one issued element and the rest of the stack above the plane;

(iii) the third level providing a separation gap between the plane of separation and the top of the at least one element that is below the plane;

(c) slide means having a leading face whose upper leading edge is below and downwardly spaced apart from the duct lower end so as to define a separation gap therebetween, the slide face being returnably advanceable from a first position to a second position, and returnably advanceable from the second position to a third position, (i) the first position existing when the plunger top is at the first level, the first position being such that the leading slide face will be spaced apart from the at least one element supported on the plunger top;

(ii) the second position existing when the plunger top is at the second level, the second position being such that the leading slide face will be pushed against the at least one issued element so as to provide first sideways shift of the at least one issued element supported on the plunger top, the top of the slide in the second position preventing descent of the stack;

(iii) the third position existing when the plunger top is at said third level, said third position being such that the leading slide face is pushed against the first shifted at least one issued element so as to provide second sideways shift of and removal from the piston top of that at least one element, the top of the slide means in the third position preventing descent of the stack.

A third aspect of the present invention provides a method of separating at least one sheet metal element from a stack of apertured sheet metal elements, comprising carrying out that separation with a plurality of motion phases by utilising apparatus according to the first aspect of the present invention.

In the present invention, sheet metal elements that might hang fast on one another in the stack are detached from one another in the separation plane. Sheet metal elements to be separated from the stack can at first be slightly displaced by motion of translation and/or of rotation, in order to obviate catching of sheet metal elements on one another. The first shift can prevent catching on edges and burrs of apertures during the second shift.

The apparatus of the present invention can be embodied in any suitable manner(s). For example, the duct can have a circular cross section for circular sheet metal elements. The plunger means can have at least two upwardly extending supports between which the slide means can advance. The slide means can be a single member. Alternatively, the slide means can comprise a plurality of slide members, comprising e.g. a first slide member above a second slide member, the first slide member being advanceable from the slide first position to the slide second position, the second slide member being advanceable from the slide second position to the slide third position. The slide means can be adapted such that at least a portion of motion thereof comprises translatory motion and/or rotary motion.

The apparatus of the present invention can comprise projection means having a leading abutment face below the duct lower end and sideways spaced from the adjacent edge thereof, this spacing being greater than the first shift, the plunger means being reciprocatable between the slide means and the projection means, the projection abutment face having a lower edge sufficiently less than one sheet element thickness above the level of slide upper leading edge, said projection abutment face being able to abut the edge of the second shifted at least one element. The projection means can comprise a stripper surface sloping downwardly and away from the projection lower edge, the stripper surface being able to project into the path of any entrained sheet metal element that adheres to the bottom sheet metal element remaining in the duct lower end during the shifting of the at least one issued element. The slide means can comprise a recess for receiving the projection leading abutment face during corresponding advance of the slide means.

Sheet metal elements separated by means of the present invention are preferably laminations for stators, rotors, or transformers.

The plunger and the slide utilised in the present invention can be simple parts that carry out simple to and fro movements with relatively little force.

BRIEF DESCRIPTION OF THE DRAWINGS

One example of apparatus of the present invention is shown in the accompanying drawings, wherein:

FIG. 1 is a vertical section through the apparatus.

FIG. 2 is a vertical section at right angles to FIG. 1.

FIGS. 3 to 6 show respective operative configurations of the apparatus of FIGS. 1, 2.

DETAILED DESCRIPTION OF THE PREFERRED EMBODIMENTS

In the drawings, guide duct 3 contains vertical stack 4 of sheet metal elements having punched apertures (not shown). Duct 3 has a lower end from which successive elements can issue gravitationally onto the top of reciprocatable plunger 1. Transverse slide 2 and downward projecting projection 5 are below the bottoms of respective opposite side regions R, L of the duct lower end, and are at respective opposite side regions of the path of plunger 1. Slide 2 has a leading face having an upper leading edge 8 spaced apart from the bottom of the adjacent duct end side region R. Projection 5 has a top abutting the bottom of the adjacent duct end side region L. The bottom of region R is shown at a level below the level of the bottom of edge 9 of region L. Projection 5 has a leading vertical abutment surface 6, and a stripper surface 7 sloping downwardly and away from surface 6.

For reliable operation, the following dimensional relationships should apply. Upper leading edge 8 of slide 2 should be at a level below the level of duct lower end edge 9; this differential should be more than one sheet metal element thickness but less than two sheet metal element thicknesses, and preferably be in the range 1.4 to 1.6 times the thickness of a sheet metal element. Projection 5's abutment surface 6 should have a height somewhat less than the thickness of a sheet metal element, e.g. substantially 0.8 times the thickness of a sheet metal element.

Depending on the particular form of the sheet metal elements, plunger 1 and slide 2 have to be shaped and disposed so as not to stand in each other's way when they move. For this purpose (see FIG. 2), plunger 1 has two external vertical straight ribs or flanges 10' with a sufficiently large recess 10 therebetween into which slide 2 can advance. Internal side surfaces of flanges 10' can guide this entry of slide 2. Plunger 1 and slide 2 can be embodied with appropriate cross sections for sheet metal elements shaped differently from those for FIG. 2.

The initial operative configuration of the apparatus is shown in FIGS. 1 and 2. FIG. 1 shows plunger 1's top at the level of slide 2's upper leading edge 8, that edge being sideways spaced apart from said top by a distance corresponding to a neutral position of slide 2. Stack 4 rests on plunger 1's top.

For the first working step (from FIGS. 1, 2 to FIG. 3), plunger 1 descends in the direction of the arrows in FIGS. 1, 2, so that plunger 1's top arrives at the operative level shown in FIG. 3. This descent corresponds to the height of a required pack 12 of sheet metal elements to be separated from stack 4. This height corresponds to the number of those elements to be in pack 12, and is adjustable to allow change in that number. Stack 4 continues to rest on plunger 1's top.

For the second working step (from FIG. 3 to FIG. 4), slide 2 advances towards pack 12 that rests on plunger 1's top, and pushes pack 12 to shift it sideways. The shifted pack remains on plunger 1's top (FIG. 4). This shift should be limited to an amount at which no punching burrs or other irregularities on the sheet metal element surfaces have as yet impinged on one another and perhaps become caught on one another, because such surfaces can slide relative to each other. The shift occurs along a plane of separation between the top of pack 12 and the bottom sheet element in the duct lower end.

the stack) should project into a notional downward projection of the stack, so that at the subsequent separating descent of pack 12 (FIG. 5), the remainder of the stack is supported on slide 2 or the other slide, with a separation gap 11 between the top of the pack 12 and the underneath of the bottom of the supported stack remainder.

One modification is that slide 2 may comprise two individual slide members one above the other, the upper slide member providing upper leading edge 8 such that it is at a higher level than the upper leading edge of the lower slide member. The upper slide member provides said first sideways shift shown in the change from FIG. 3 to FIG. 4, whereas the lower slide member provides said second sideways shift shown in the change from FIG. 5 to FIG. 6. In the second sideways shift, the lower slide member has the advantage of not rubbing against the bottom sheet metal element of the remaining stack.

Duct 3 need not be formed of solid walls, but may be formed e.g. by a few guide bars distributed about the periphery of the sheet metal elements in accordance with the form of those elements. The feeding of further sheet metal elements to duct 3 can be effected continuously from above, or discontinuously element by element, or in relatively large groups.

A particular advantage is that slide 2 allows simple and quick change to other pack heights. To do that, one can vary the descent of plunger 1 in the change from FIG. 1 to FIG. 3. Alterations in pack height are required very frequently in one preferred field of use of the present invention, i.e. in the forming of packs of laminations for stators, rotors, or transformers.

I claim:

1. Apparatus suitable for separating at least one sheet metal element from a stack of apertured sheet metal elements, comprising:

(a) guide duct means for guideably issuing said stack, said duct having a lower end from which can gravitationally issue said at least one element;

(b) plunger means lowerable so that the top thereof returnably descends from a first level to a second level, and returnably descends from said second level to a third level, (i) said first level enabling said plunger top to support thereon said stack;

(ii) said second level providing lowering of said at least one issued element and lowering of the rest of said stack, such that a plane of separation will exist between the top of said at least one issued element and the rest of said stack above said plane;

(iii) said third level providing a separation gap between said plane of separation and the top of said at least one element that is below that plane;

(c) slide means having a leading face whose upper leading edge is below and downwardly spaced apart from said duct lower end so as to define a separation gap therebetween, said slide face being returnably advanceable from a first position at one side of the duct lower end to a second position, and returnably advanceable from said second position to a third position, (i) said first position existing when said plunger top is at said first level, said first position being such that said leading slide face will be spaced apart from said at least one element supported on said plunger top;

(ii) said second position existing when said plunger top is at said second level, said second position being such that said slide leading face will be pushed against said at least one issued element so as to provide first sideways shifting of said at least one issued element supported on said plunger top, the top of said slide in said second position preventing descent of said stack therebelow;

(iii) said third position existing when said plunger top is at said third level, said third position being such that said leading slide face will be pushed against said first shifted at least one issued element so as to provide second sideways shifting of and removal from said plunger top of that at least one element and wholly off of said plunger top, the top of said slide means in said third position preventing descent of said stack.

2. Apparatus as claimed in claim 1, wherein said plunger means has at least two upwardly extending supports between which said slide means can advance.

3. Apparatus as claimed in claim 1, wherein said slide upper leading edge is at a level below the level of the further side of said duct lower end, this differential being more than one sheet metal element thickness and less than two sheet metal element thicknesses.

4. Apparatus as claimed in claim 1, wherein said slide means is a single slide member.

5. Apparatus as claimed in claim 1, wherein said slide means is adapted such that at least a portion of motion thereof comprises translatory motion.

6. Apparatus as claimed in claim 1, wherein said slide means is adapted such that at least a portion of motion thereof comprises rotary motion.

7. Apparatus as claimed in claim 1, comprising projection means having a leading abutment face below said duct lower end and sideways spaced from the further side thereof, this spacing being greater than said first shift, said slide means being reciprocatable during movement from the second position to the third position between said plunger means and said projection means, said abutment face having a lower edge sufficiently less than one sheet element thickness above the level of said slide upper leading edge, said leading abutment face being able to abut the edge of any element entrained on top of said slide upper surface during movement of said slide from the second position to the third position.

8. Apparatus as claimed in claim 7, wherein said projection means comprises a stripper surface sloping downwardly and away from said abutment face lower edge, said stripper surface being able to project into the path of any at least one said sheet metal element that adheres to the bottom sheet metal element remaining in said duct lower end during said shifting of said at least one said issued element by said slide means from the second position to the third position.

9. Apparatus as claimed in claim 8, wherein said slide means comprises a recess for receiving said projection leading abutment face during corresponding advance of said slide means.

10. A method of separating at least one apertured sheet metal element from the lower end of a generally vertical stack of similar apertured sheet metal elements, the method comprising the steps of:

(a) sufficiently shifting said at least one sheet metal element by translation and/or rotation relative to the remainder of the stack along a generally horizontal separation plane such that said at least one In the example shown, the shift is a distance in the approximate range 5 to 10 mm. Stack 4 continues to rest on plunger 1's top by way of shifted pack 12.

For the third working step (from FIG. 4 to FIG. 5), plunger 1 descends in the direction of the arrow shown in FIG. 4, so that plunger 1's top arrives at the operative level shown in FIG. 5. This descent produces a separation gap 11 between the top of pack 12 and the bottom sheet element in the duct lower end, that bottom sheet element resting on the top of slide 2. Thus, upper leading edge 8 of slide 2 defines a plane of separation for said stack. Separation gap 11 is just sufficient to exclude reliably any contact between the top of pack 12 and the bottom sheet element in the duct lower end. The descent of plunger 1's top to produce separation gap 11 can be in the range 3 to 4 mm for sheet metal elements having thicknesses in the range e.g. 0.5 to 1.0 mm thickness. When determining that descent, it should be borne in mind that the sheet elements in pack 12 might loosen up and fan open (FIG. 5) depending on e.g. their material and shape, as soon as they are relieved of the pressure of stack 4.

For the fourth working step (from FIG. 5 to FIG. 6), slide 2 further advances towards pack 12 that rests on plunger 1's top, and pushes pack 12 to shift it wholly off of plunger 1's top, e.g. onto a turntable 14 or some other conveyor, which then transports pack 12 to another work station. In that shift, the sheet elements of pack 12 are preferably pushed to abut against alignment abutment 15.

After the fourth working step, slide 2 and plunger 1 are returned to their initial positions, these returns being indicated by the arrow shown in FIG. 6.

Projection 5 (which has abutment surface 6 and stripper surface 7) is of substantial significance for reliable operation of the apparatus; because, it has to be assumed that sheet metal element thickness exhibits very considerable tolerances in relation to sheet design or intended thickness, and that individual very light sheet metal elements often stick and hang on one another. Thus, upper leading edge 8 of slide 2 must be below the level of the further edge 9 of the duct lower end, by a spacing of more than the maximum sheet metal element thickness occurring in actual practice, so as to prevent slide 2 engaging a sheet metal element that is partly within the duct lower end. But, if the difference in levels of edges 8 and 9 amounts to more than one sheet metal element thickness, there is a possibility that an individual sheet metal element 16 (see FIGS. 4 to 6), more particularly a narrow element within the limits of the tolerance range, has unintentionally issued completely from duct 3; i.e., so that this element's top is under edge 9 but has not yet been engaged by slide 2, because the underneath of element 16 is above upper leading edge 8 of slide 2. At the advance of slide 2 as shown in FIG. 4, such an element 16 is carried by friction (i.e. entrained) into an indeterminate intermediate position. In order to limit this unintentional entrainment to a harmless small travel, abutment surface 6 is provided on projection 5. In the direction of advance of slide 2, abutment surface 6 is so far beyond edge 9 of the duct lower end that at the short first advance of slide 2 (shown by the change from FIG. 3 to FIG. 4), shifted sheet metal elements do not quite reach abutment surface 6. Then, after pack 12 (FIGS. 5, 6) has been lowered sufficiently (FIG. 5), the sheet metal elements of pack 12 no longer abut abutment surface 6. Instead, only element 16 abuts abutment surface 6. Element 16 in fact takes up a somewhat offset position (see FIG. 6) in relation to stack 4. Thus, when the stack 4 is lowered in the next pack-forming operations, element 16 will be lowered a distance corresponding to the pack height, and be the lowest element in the next pack 12. When shifted onto turntable 14, element 16 is aligned by abutment 15, so that element 16 is in line with the other sheet metal elements of the next pack 12.

It will be appreciated that abutment surface 6 prevents disturbances to the normal course of operations, those disturbances being caused by uncontrollably displaced sheet metal elements 16.

As has already been mentioned, the sheet metal elements can adhere to each other, even after the first sideways shift has occurred. Thus, the top sheet metal element of pack 12 when fully engaged by slide 2 (despite side shift shown in FIGS. 4 and 5) might adhere to bottom sheet of the remaining stack 4, or to an element 16, so that separation gap 11 forms not at the intended place above the top of pack 12, but between elements of pack 12, depending on how many of those elements adhere together and remain hanging underneath the bottom element of the remaining stack 4. Stripper surface 7 of projection 5 ends, as early as possible, this undesirable sticking of one or more elements of pack 12 to the bottom element of the remaining stack 4, in as simple and well-controlled a way as possible. Stripper surface 7 is so dimensioned as to its height that, at pack 12's sideways shift in the change from FIG. 5 to FIG. 6, stripper surface 7 only projects into the path of motion of a sheet metal element that adheres to the bottom element of the remaining stack or to element 16, but not into the path of motion of the top element of pack 12, if the separation gap 11 has formed as intended at the upper leading edge 8 of slide 2.

So that projection 5 does not collide with slide 2 when slide 2 advances into the position shown in FIG. 6, there is at the top of the slide 2 a groove or recess 13 (FIG. 2) whose cross-section is greater than the cross-section of projection 5 in the region up to which slide 2 advances.

Preferably, upper leading edge 8 of slide 2 and edge 9 of the duct lower end are relatively short at their respective levels. Adjacent the edge 8, the top of slide 2 is flattened (not shown); i.e., there the upper leading edge of slide 2 lies somewhat lower than the region designated as 8. Correspondingly, the region of the further edge 9 of the duct lower end is short and the lowest portion of the duct edge at that side of the duct. In this way, distortion (which is often to be observed) of sheet metal elements is taken into account. It is intended to avoid having a distorted sheet metal element being situated at one of its sides with the upper edge partly above and partly below the edge 9 of the duct lower end, with the possible addition of having the lower edge of an element at the opposite side partly above and partly below the upper leading edge 8 of slide 2. The spacing between the edges 8 and 9 should be as small as possible, if at all feasible, depending on the shape of the sheet metal elements.

By way of example, the above description describes rectilinear pushing movement of slide 2 in conjunction with FIGS. 3 and 4. If the sheet metal elements are not circular but e.g. in plan view, rectangular or U-shaped, the short first sideways shift in changing from the FIG. 3 to FIG. 4 can be a rotary movement of the lower elements to be removed. It is important that as shown in FIG. 4 slide 2 (or another slide, e.g. a rotary slide which on rotating entrains the lower sheet metal elements of metal element and the remainder of the stack do not inter-engage at their apertures, said shifting causing an uncovering of a portion of the bottom of the lowermost element in the remainder of the stack;

(b) lowering from the separation plane said at least one sheet metal element away from the remainder of the stack;

(c) supporting vertically, as said at least one sheet metal element is lowered, the remainder of the stack at the uncovered portion of the lowermost element in the remainder of the stack; and (d) shifting said at least one sheet metal element sideways such that said at least one sheet metal element and the remainder of the stack are completely separated.

* * * * *